United States Patent [19]

Daumas

[11] Patent Number: 4,952,282

[45] Date of Patent: Aug. 28, 1990

[54] PATTERN PLATE FOR MAKING MOULDS INTENDED FOR THE PRODUCTION BY SAND CASTING OF WINDOW SEALS OR SIMILAR ARTICLES HAVING AN UNDERCUT BEAD

[75] Inventor: Claude G. Daumas, Arnage, France

[73] Assignee: Societe Mancelle De Fonderie, Arnage, France

[21] Appl. No.: 376,008

[22] Filed: Jul. 6, 1989

[30] Foreign Application Priority Data

Jul. 7, 1988 [FR] France ..... 88 09257

[51] Int. Cl.[5] ..... B22C 7/04; B22C 9/22

[52] U.S. Cl. ..... 164/245; 164/241

[58] Field of Search ..... 164/241, 239, 245, 377, 164/378, 180, 213, 384

[56] References Cited

U.S. PATENT DOCUMENTS 3,624,758 11/1971 Harris ..... 164/245
3,773,100 11/1973 Mawson et al. ..... 164/378

FOREIGN PATENT DOCUMENTS 1201272 3/1986 Canada ..... 164/213
2020157 10/1970 Fed. Rep. of Germany .
2940171 8/1979 Fed. Rep. of Germany .
3602049 7/1987 Fed. Rep. of Germany .
2147163 9/1973 France .

*Primary Examiner*—Richard K. Seidel
*Assistant Examiner*—Rex E. Pelto
*Attorney, Agent, or Firm*—Beveridge, DeGrandi & Weilacher

[57] ABSTRACT

A pattern plate for making moulds intended for use in the production by sand casting of window seals or similar articles having an undercut bead, includes a plate, a fixed exterior part, an axially movable interior part and a elastomeric ring connecting the interior and exterior part. The interior part moves axially over a short path defined within the exterior part by mechanical stops between an extended position, to which it is pushed back by springs, and a retracted position which it assumes through the action of the compaction pressure. During compaction, an annular elastomer ring located between the interior and exterior parts compresses to compact the mold material in a lateral direction. Upon release, the elastomeric ring returns to its original position facilitating the removal of the mould.

10 Claims, 2 Drawing Sheets

PATTERN PLATE FOR MAKING MOULDS INTENDED FOR THE PRODUCTION BY SAND CASTING OF WINDOW SEALS OR SIMILAR ARTICLES HAVING AN UNDERCUT BEAD

The invention relates to the production by sand casting of articles having undercut parts, and more particularly window seals or similar castings having a protuberance in the form of an annular bead.

For the solution of this problem the document FR-A-No. 2 147 163 in the name of CATERPILLAR discloses a pattern plate in which each pattern has a rubber covering ending at the undercut top part in a portion made solely of rubber in order to be sufficiently flexible to enable the pattern to be extracted without tearing away the sand surrounding this flexible portion. However, if this extraction is to be possible without tearing away sand, the sand must be sufficiently hardened to have the necessary cohesion to bring about this flexion of the rubber rim.

For the purpose of avoiding this requirement, the document DE-A-No. 29 40 171 in the name of GOETZE also discloses a similar pattern plate in which the flexible rim has in the position of rest a shape having no undercut and is widened by outward flexion solely through the action of the pressure of the sand when the mould is compacted. However, this widening-out through flexion is of a rather unpredictable nature, since the displacement of the sand particles during compacting is not a perfectly homogeneous phenomenon, so that the shape obtained is not perfectly regular.

The aim of the invention is to obviate the abovementioned disadvantages, that is to say to provide a pattern plate forming in the sand the site for a bead which is undercut on the compression of the sand but has no undercut on the extraction of the mould or pattern, while the geometry of the shape obtained in this manner is perfectly controlled and independent of the hazards entailed by operating conditions.

For this purpose the invention consists essentially in making the deformable part in the form of an annular ring gripped between a fixed exterior part and an axially movable interior part In particular, the invention provides for each pattern on the plate to comprise three parts: a fixed exterior part having the external profile of the casting from the joint plane to the start of the bead and having internally a bore slightly larger than that of the casting; an interior part embedded in the pattern plate and movable axially over a short path defined by mechanical stops between an extended position, to which it is returned by resilient means, and a retracted position to which it is pushed back by the pressure of the sand during the compacting, this movable interior part having internally a blind bore which has the same inside diameter as the casting to be produced and whose bottom is situated level with the reference plane of the pattern plate in said retracted position, while the outer surface of said interior part is adjusted to slide in the inside bore of the exterior part over at least the height of the latter and ends at the top in the form of an outwardly projecting rim; and finally an elastomer ring mounted on the periphery of said interior part, between said rim and the end of the exterior part, said elastomer ring having, at rest, a shape which completely fills the space existing between said rim and said top of the exterior part in said extended position, without having any undercut on the outside, in such a manner that in the retracted position it undergoes deformation by axial compression and transverse expansion towards the outside in order to form said site for the bead.

Said annular elastomer ring, as well as the site intended for it, preferably have a section effecting its retention, for example a dovetail section.

Other features of the invention will emerge from the following description of one embodiment, which is taken as an example and illustrated in the accompanying drawing, in which.

Figure 1:
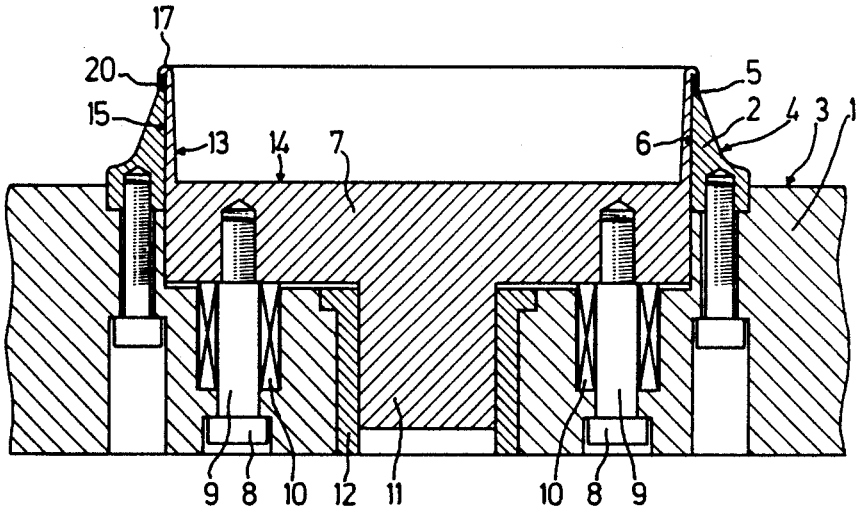
FIG. 1 is a section of the pattern plate, taken on the axis of one of the patterns in the extended position.

In the drawings can be seen the pattern plate 1, which generally comprises a plurality of patterns of which only one is shown. The exterior part 2 is fixed on said plate by the usual means, and optionally embedded in it, the portion of said part 2 which projects above the reference plane 3 of the pattern plate 1 having an external profile 4 representing the external shape of the required casting from the reference plane 3 to the point 5 which corresponds to the start of the undercut bead. Said exterior part 2 is bounded internally by a bore 6 of a diameter slightly greater than the bore of the required casting.

It is also possible to see the interior part 7, which is partly embedded in the pattern plate 1 and which is mounted for axial movement over a short path perfectly defined between mechanical stops. For example, in the extended position shown in FIG. 1, these stops may be composed of the heads 8 of shouldered screws 9 which come to bear against the pattern plate through the action of springs 10, which are for example concentric to the screws 9. In the retracted position shown in FIG. 2 it may simply be the bottom of the part 7 which comes to bear against the bottom of the embedment socket provided in the plate 1. A central guide 11 sliding in a longitudinal bearing 12 may optionally improve the parallelism of the movement.

Figure 2:
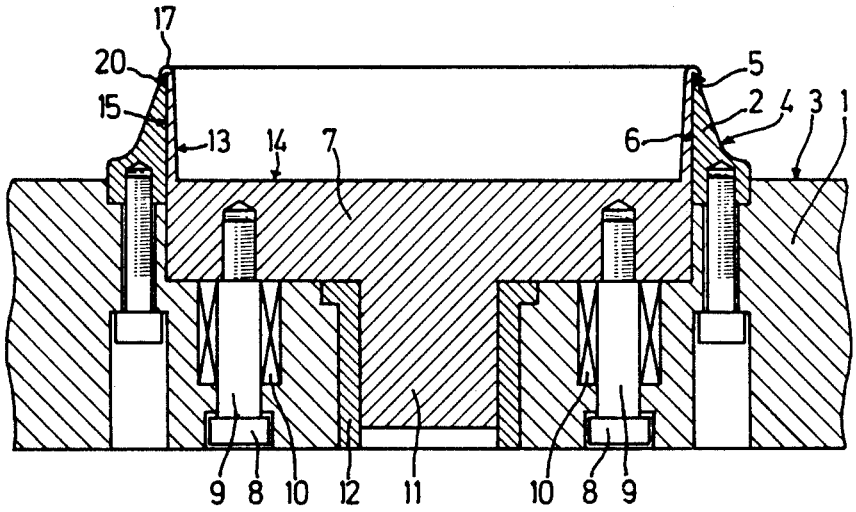
FIG. 2 is a corresponding section in the retracted position.

The movable interior part 7 has a blind interior bore 13 whose diameter is the same as that of the required casting, and whose bottom 14, in the retracted position shown in FIG. 2, is exactly level with the reference plane 3 of the pattern plate 1. The exterior surface 15 of said interior part 7 is adjusted to slide inside the bore 6 in the fixed interior part 2, at least over the entire height of the latter, and the cylindrical wall 16 of slight thickness thus formed between the bores 6 and 13 is provided at its free end with a rim 17 projecting outwards but never beyond the diameter of the circle 5 representing the limit of the bead.

The top part of the cylindrical surface 15 of the wall 16, in conjunction with the facing surfaces 18 and 19 of the top edge of the fixed part 2 and of the rim 17 of the movable part 7 respectively, defines the three sides of a preferably dovetail-shaped section, into which an annular elastomer ring 20 fits exactly; in the position of rest, that is to say therefore in the extended position shown in FIG. 1, the outside diameter of said ring 20 does not exceed or is smaller than the diameter of the previously defined circle 5, so that it has no undercut. This outside diameter of the ring 20 is even preferably slightly smaller than that of the circle 5, so as to allow for any residual deformation of the elastomer, which is always possible.

Figure 3:
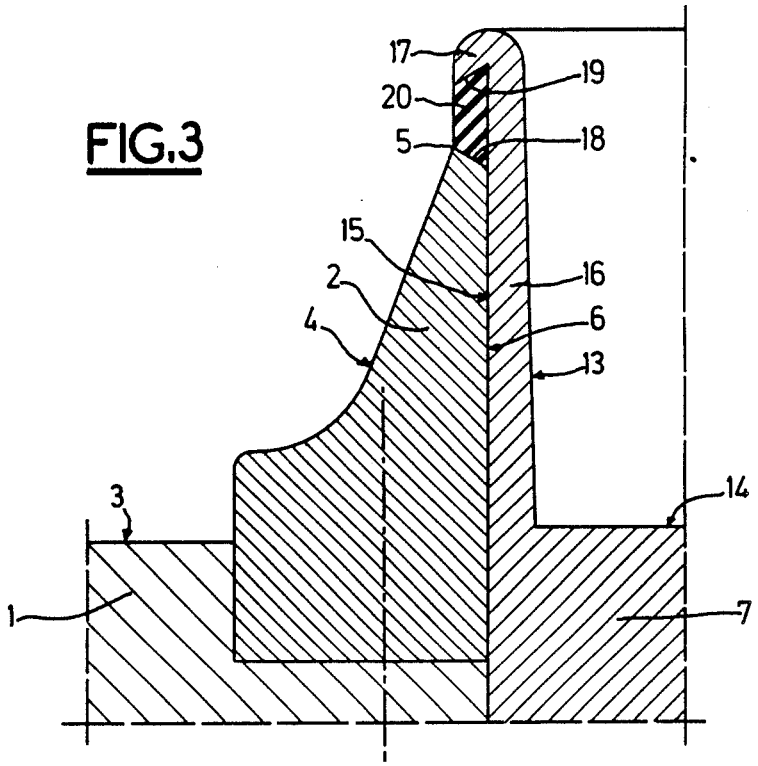
FIGS. 3 and 4 show on a larger scale details of FIGS. 1 and 2 respectively.
Figure 4:
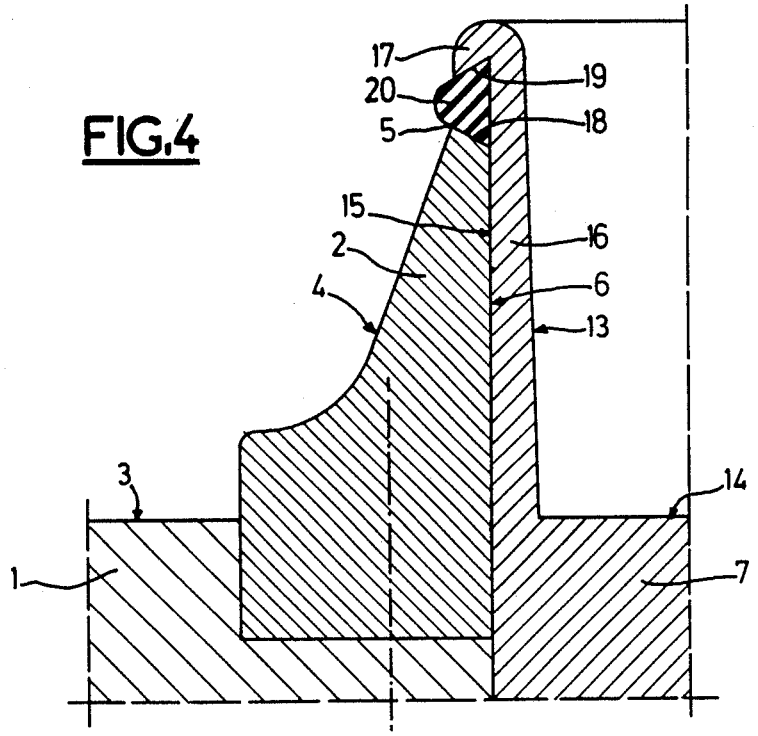

When a pattern plate of this kind is used in the customary sand casting process, the compaction pressure of the sand, whatever the value of that pressure provided that it exceeds a minimum value, and its degree of homogeneity have the effect, by acting on the wide surface offered by the part 7, of displacing the latter, against the action of the springs 10, to its retracted position shown in FIG. 2, which has the consequence of axially compressing the annular part 20 to a perfectly defined extent, and, as said annular part 20 is already accurately retained on three sides of its section in accurate mechanical parts, it can be deformed only by expansion towards the outside by a clearly defined amount and in accordance with a precise geometry, as illustrated in FIG. 4. During the decompression accompanying the extraction of the mould or pattern plate the annular ring 20 obviously resumes its shape free from undercut as shown in FIGS. 1 and 3, because of its inherent elasticity and with the assistance of the force of the springs 10, thus enabling this extraction to be effected easily without any risk of damage to the sand mould produced and without requiring any particular cohesion hardness of this sand.

The sand mould thus formed is obviously then closed and the metal is poured in the usual manner for the production of castings having the exact shape desired, with great precision and great regularity of shape.

I claim:

1. A pattern plate for making moulds for sand casting articles having an undercut bead, said pattern plate having a fixed exterior part, an axially movable interior part mounted inside said exterior part, and an elastomeric bead-forming part, said bead-forming part having no undercut and being outwardly deformable to form a casting site for a bead in response to subjection of said pattern plate to compaction pressure of sand in a mould.

2. A pattern plate according to claim 1 wherein said exterior part extends to said bead-forming part and has an external surface shaped to correspond to the article produced, said exterior part having an internal surface with a bore slightly larger than that of the article produced.

3. A pattern plate according to claim 2 having mechanical stop means for limiting axial movement of the interior part to a short path of movement from an extended position to a retracted position which it occupies in response to sand compaction pressure, springs for biasing said interior part to its extended position, said interior part having an exterior surface which is slidable in the exterior part, said movable interior part terminating at an upper rim which has an outside diameter no greater than that of said bead-forming part when the interior part is in its extended position.

4. A pattern plate according to claim 3 wherein the interior part has a cylindrical exterior surface adjacent to said upper rim, said exterior part having an end surface facing said upper rim of the interior part, and the bead-forming part being fitted exactly into a space defined by said cylindrical exterior surface, said rim and said end surface; said bead-forming part having an external surface which does not protrude radially beyond said end surface of the exterior part when the interior part is in its extended position.

5. A pattern plate according to claim 3 wherein the interior part has a blind internal bore having an inside diameter corresponding to that of an article cast by the mould, said blind internal bore having a bottom surface, said pattern plate having a reference surface which is coplanar with said bottom surface when the interior part is in its retracted position, whereby subjection of the pattern plate to sand compaction pressure in a mould subjects the entire exposed surface of the interior part to pressure of sand to force the interior part to its retracted position, thus compressing the bead-forming part to expand it radially by a precise amount to form said site for casting a bead, said bead-forming part being returnable to an original shape having to undercut to permit retraction of said pattern plate from a sand mould.

6. A pattern plate according to claim 1 wherein the bead-forming part and a space which receives it each have a dovetail shape.

7. A pattern plate according to claim 3 wherein the mechanical stop means are shouldered screws provided with heads positioned to limit axial movement between the interior and exterior parts.

8. A pattern plate according to claim 7 wherein the springs are helical compression springs disposed coaxially around at least some of said shouldered screws.

9. A pattern plate according to claim 3 wherein the exterior part has a socket which receives the interior part, said socket having a bottom which is strikable by said interior part to determine there tracted position of the interior part.

10. A pattern plate according to claim 1 wherein the exterior part has a longitudinal bearing, and the interior part has a central guide slidably mounted in said bearing.

* * * * *